US007493948B2

(12) United States Patent
Cooper et al.

(10) Patent No.: US 7,493,948 B2
(45) Date of Patent: Feb. 24, 2009

(54) WELLBORE CONSOLIDATING TOOL FOR ROTARY DRILLING APPLICATIONS

(75) Inventors: Iain Cooper, Sugar Land, TX (US); Claude Vercaemer, Paris (FR); William Lesso, Houston, TX (US); Benjamin Peter Jeffryes, Histon (GB); Michael Charles Sheppard, Hadstock (GB)

(73) Assignee: Schlumberger Technology Corporation, Cambridge, MA (US)

( * ) Notice: Subject to any disclaimer, the term of this patent is extended or adjusted under 35 U.S.C. 154(b) by 108 days.

(21) Appl. No.: 10/538,863

(22) PCT Filed: Dec. 17, 2003

(86) PCT No.: PCT/GB03/05520

§ 371 (c)(1),
(2), (4) Date: Dec. 19, 2005

(87) PCT Pub. No.: WO2004/057151

PCT Pub. Date: Jul. 8, 2004

(65) Prior Publication Data

US 2006/0144620 A1 Jul. 6, 2006

(30) Foreign Application Priority Data

Dec. 21, 2002 (GB) ..... 0229865.1

(51) Int. Cl.
*E21B 17/10* (2006.01)

(52) U.S. Cl. ..... 166/241.3; 166/222; 166/173; 175/72; 175/325.3

(58) Field of Classification Search ..... 166/241.1, 166/241.3, 173, 222, 223; 175/57, 72, 320, 175/324, 325.2, 325.3, 325.6
See application file for complete search history.

(56) References Cited

U.S. PATENT DOCUMENTS

| | | | | |
|---|---|---|---|---|
| 2,714,500 | A * | 8/1955 | Snyder | 175/323 |
| 2,776,111 | A | 1/1957 | Vance | |
| 3,097,707 | A * | 7/1963 | Kammerer | 175/258 |
| 3,196,951 | A * | 7/1965 | Saurenman | 166/241.6 |
| 4,049,066 | A | 9/1977 | Richey | |
| 4,602,690 | A * | 7/1986 | Steiger | 175/325.6 |
| 5,622,453 | A | 4/1997 | Finlay et al. | |
| 5,911,285 | A * | 6/1999 | Stewart et al. | 175/317 |
| 6,968,897 | B2 * | 11/2005 | Doyle et al. | 166/214 |

(Continued)

FOREIGN PATENT DOCUMENTS

SU 1361304 A1 1/1986

OTHER PUBLICATIONS

Fontenot et al Casing drilling proves successful in South Texas World Oil, Oct. 2002, pp. 27-32.

(Continued)

*Primary Examiner*—Jennifer H Gay
*Assistant Examiner*—Daniel P Stephenson
(74) *Attorney, Agent, or Firm*—James McAleenan; Jody DeStefanis; Steven Gahlings

(57) ABSTRACT

The present invention generally relates to an apparatus and methods for improving the stability of a wellbore during drilling operations using a rotary drill string. More specifically, embodiments of the present invention provide systems and methods for enhancing the performance of the filter or mud cake layer on the wall of the wellbore as a protective and isolating layer.

16 Claims, 9 Drawing Sheets

U.S. PATENT DOCUMENTS

| | | | | |
|---|---|---|---|---|
| 7,013,992 | B2 * | 3/2006 | Tessari et al. | 175/57 |
| 7,096,940 | B2 * | 8/2006 | Baxter et al. | 166/241.6 |
| 7,191,830 | B2 * | 3/2007 | McVay et al. | 166/242.1 |
| 2005/0167159 | A1 * | 8/2005 | Bailey et al. | 175/72 |
| 2007/0114063 | A1 * | 5/2007 | Wilfredo | 175/57 |

OTHER PUBLICATIONS

Shepard et al Casing drilling: an emerging technology SPE/IADC 67731 SPE/IADC Drilling Conference, The Netherlands, Feb.-Mar. 2001.

* cited by examiner

WELLBORE CONSOLIDATING TOOL FOR ROTARY DRILLING APPLICATIONS

The present invention generally relates to apparatus and methods for improving the stability of a wellbore during drilling operations using a rotary drill string. More specifically, it relates to such apparatus and methods to enhance the performance of the filter or mud cake layer on the wall of the wellbore as protective and isolating layer.

BACKGROUND OF THE INVENTION

To obtain fluids, such as oil and gas, from a subterranean reservoir boreholes or wells are drilled from the surface into the reservoir. The most commonly applied method to drill a well uses a derrick or mast structure, in which a drill string is assembled and continuously extended into the borehole as the drilling progresses. Drilling is performed by rotating a drill bit attached to the end of the drill string. During the drilling process pressurized drilling fluid (commonly known as "mud" or "drilling mud") is pumped from the surface into the hollow drill string to provide lubrication to various members of the drill string including the drill bit. On its way back to the surface through the annulus between drill string and the wall of the borehole, the drilling fluid removes the cuttings produced by the drill bit.

In most cases the pressure exerted by the drilling fluid is above the formation or pore pressure to prevent the entry of formation fluids into the wellbore during the drilling process. As a beneficial side effect, a small amount of pressurized mud enters into porous sections of the formation as it flow across those, thus leaving behind a layer of larger particles on the borehole wall. This layer is referred to as filter or mud cake. The mud cake layer prevents further fluid loss, which can be harmful, damaging formation permeability and lubricating fractures.

The barrier provided by the mud cake can potentially increase the so-called "mud window". The mud window is a pressure range in which the driller maintains the mud pressure. The mud pressure should be sufficiently high to prevent influx from the formation whilst being low enough to prevent a fracturing of the formation and lost circulation. A wider mud window has the advantage of effectively increasing the distance that can be drilled before the open borehole requires a casing. With an increased distance between subsequent casing shoes or points, the drilling operation can be completed in a shorter time period and at reduced costs.

Considerable efforts have therefore been made to optimize the filter cake as a protective layer—mostly by adding suitable chemical compositions to the base drilling fluid in order to increase the stability of the mud cake and the adjacent formation or to increase its capability of the mud cake layer to isolate the borehole from the surrounding formation.

In the patent document SU 1361304 a bit with two off-set pairs of rollers is described for a compacting action onto the wall of a borehole. The roller are described as cylindrical rubber cased sleeves. However rubber when exposed to the hostile environment close to the drill bit exhibits a high degree of wear and tear, making the tool impractical for most applications.

In the light of the above, it is an object of the present invention to advantageously condition the interface layer between an open uncased wellbore and the surrounding formation during drilling operations.

SUMMARY OF THE INVENTION

In accordance with a first aspect of the invention, there is provided a subpart of a drill string with a drill bit, which subpart including an outer circumferential surface that is contoured and adapted to engage the wall of the borehole with a small angle of attack in a sliding action while exerting a compacting pressure on mud cake and/or cuttings present in the annulus between the drill string and the wall.

In accordance with another aspect of the invention, there is provided a subpart of a drill string, wherein, under operating conditions, the outer circumferential surface of the subpart has a nominal outer diameter of at least 70 percent of the nominal diameter of the borehole, openings or grooves to allow the passage of drilling fluid from the drill bit to the surface and is adapted to engage the wall of the borehole in horizontal direction at an angle of attack of less than 45 degrees.

A drill string for use in the present invention may be a conventional jointed drill string or a continuous coiled drill string. The invention can, however, not be applied to casing drilling operations where the drill string is assembled up from casing tubes. A subpart is a part adapted to be incorporated into the drill string or into the bottom hole assembly (BHA) including the drill collars. The subpart is directly coupled to the drill string and rotates together with the whole drill string. The drill string in turn is rotated from a rig located at the surface.

For the purpose of the present invention the nominal outer diameter is defined as the minimal circle to include the outer circumferential surface of the subpart at an arbitrary horizontal cross-section. This outer diameter, when variable, is assumed by the subpart under operating conditions, i.e., during the actual drilling and may be smaller for some embodiments during other operations such as assembling and tripping. The nominal diameter of an open borehole is its envisaged diameter as appearing in the relevant drilling schedule and is essentially determined by the active width of the drill bit or any underreamer following the drill bit.

In preferred variants of the invention the nominal outer diameter (OD) may exceed 80, 90 or even 95 percent of the nominal borehole diameter, as the subpart is configured to remain in continuous contact with the wall of the borehole as the subpart rotates with the drill string. Furthermore, a larger OD can provide a smaller angle of attack and a larger area of contact.

It will be appreciated by those skilled in the art that in conventional drilling including coiled tubing but excluding casing drilling, subs with such a large OD are rarely used. As mentioned above, in a typical drill string make-up the drill bit (or any underreamer following it) defines the nominal borehole diameter. The other parts of the drill string are usually optimized to exhibit a small outer diameter so as to interfere as little as possible with the wall of the well as it is being drilled. Certain types of steerable motors assemblies make use of extendable members that push the drill bit in a predetermined direction. However, usually only one of these members is extended so that the outer OD of such a steerable motor assembly, following the definition of the outer OD as given above, remains small compared to the diameter of the borehole at any given point in time. Exceptionally so-called stabilizers, centralizers or tool joint protectors may exceed the above given limits. These parts however are generally not designed to preserve and enhance the integrity of the mud cake. To the contrary, the stabilizers usually include sections that contact the wall of the borehole with a low angle of attack. The same applies to expandable underreamers.

The subpart in accordance with the above aspect of the invention, however, is adapted to engage with the wall of the well at a low angle of attack so as to minimize any scraping or cutting action of the subpart on the mud cake or formation wall. Instead, the subpart is designed slide on the filter cake in a motion similar to plastering walls, hence without destroying the integrity of the filter cake layer but exerting pressure to compact the filter cake layer. The angle of attack is defined as the angle between the cutting edge of the tool and the plane tangential to the surface to which the tool is applied and at the point or line of contact. The angle of attack, thus defined, can range from 0 degrees to 180 degrees. For the purpose of the invention no cutting or gouging action is intended to be performed by the subpart. The edge or face of the subpart that engage the wall are shaped to have an angle of attack of less than 45 degrees, more preferably less than 20 degrees or even 10 or 5 degrees. Depending of the shape of the contour of the outer surface of the subpart, the angle of attack may well be below 1 degree.

Instead of cutting or gouging the subpart is designed to exert in a sliding motion a mechanical pressure on the borehole wall and any layer of mud cake, thereon. Preferably, the circumference of the subpart is contoured to engage the wall along one or more lines or one or more contact areas. Thus it is adapted to have a large area of contact with the wall to ensure that, while the drill string is rotated, the outer circumference of the subpart is brought into contact with most, if not the entire wall. It will however be appreciated that under operational conditions the actual contact area may vary and the subpart's action may deviate from the ideal behavior described above.

Also the subpart is adapted to exert only minimal forces in non-radial directions. Specifically it is adapted to reduce or minimize lateral forces in direction of the axis of the borehole. The device thus generates low resistance against the progress of the drill bit and avoids scraping or cutting actions in this direction.

In another preferred embodiment of the invention the subpart includes a cylindrical section of pipe with a large central bore through which drilling fluid is pumped from the surface to the drill bit.

To resist the abrasive nature of the interaction with the filter cake and the cuttings, at least the parts of the surface that contact the wall of the borehole are made of a hard metal, such as steel, or include specific abrasive-resistant pads, for example pads of silicone carbide or other engineering ceramics. Preferably the flexible elements of the subparts are also made from metal, exploiting the inherent flexibility of thin metal.

In a first variant of this embodiment the outer face or circumferential surface of the subpart is contoured or shaped into a plurality of smooth wave-like protrusions separated by grooves or troughs. The shape of the protrusions is adapted to contact the borehole wall with a very low angle of attack. The grooves provide flow paths for the return flow of the drilling mud to the surface. Grooves and protrusions may be arranged in straight lines parallel to the axis of the drill string or may be wound helically around it.

In a second variant of this embodiment the outer face or circumferential surface of the subpart is essentially cylindrically with one or more flow ports tunneling through the wall of the subpart. As the width of the annulus will be reduced due to larger OD of the subpart when compared for example with the OD of a conventional drill collar, mud and cuttings can flow through the additional flow ports provided while part of it will continue to pass through the reduced annulus between the subpart and the formation wall.

A subpart in accordance with the above embodiment may be advantageously placed in the vicinity of the drill collars or used as a replacement of a drill collar.

In a further preferred embodiment of the invention the subpart includes a compliant structure extending under operating conditions from a central tubular body towards the wall of the wellbore. The compliant structure may include elastic elements or flexures that exhibit a restoring force when deformed or compressed, or exert a pressure onto the wall of the borehole. The elements of flexures are preferably made from metal to increase the resistance against wear and tear downhole.

At its distal end the compliant structure carries one or more arcuate vane, pad or blade elements of metal or other structural material to engage the wall of the borehole. These vane elements may have a smoothly curved outer face to engage the wall at the required low angle of attack.

Preferably, the compliant structure includes a plurality of folding elements, such as arms, vanes or blades, that in their default state fold around the central body. Under operating conditions, preferably when activated hydraulically through the pressurized drilling fluid, the arms or blades and any parts mounted thereon expand until contacting the wall of the well. The compliant structure preferably fold back into its default position when the drilling fluid pressure drops and, hence, the normal drilling operation ceases.

In a variant of this embodiment, the subpart includes fluid ports or nozzles fed from the interior of the drill string. These nozzles can be used to direct a jet of drilling mud into a desired direction. This direction could be perpendicular or essentially tangentially to the wall of the well or along the outer contour of the pads that contact the wall. The jets may also be used to remove debris and drilling mud residuals from the structure.

Several subparts in accordance with the above embodiment are advantageously distributed along the length of the bottom section of the drill string, which section is to enter the newly drilled open (uncased) borehole. Thus the action of the first subpart is reinforced by other subparts passing through the same section of the well at a later time. One or more subparts may therefore be located in the drill string above the BHA and/or the drill collar section.

These and other aspects of the invention will be apparent from the following detailed description of non-limitative examples and drawings.

EXAMPLES

Figure 1A:
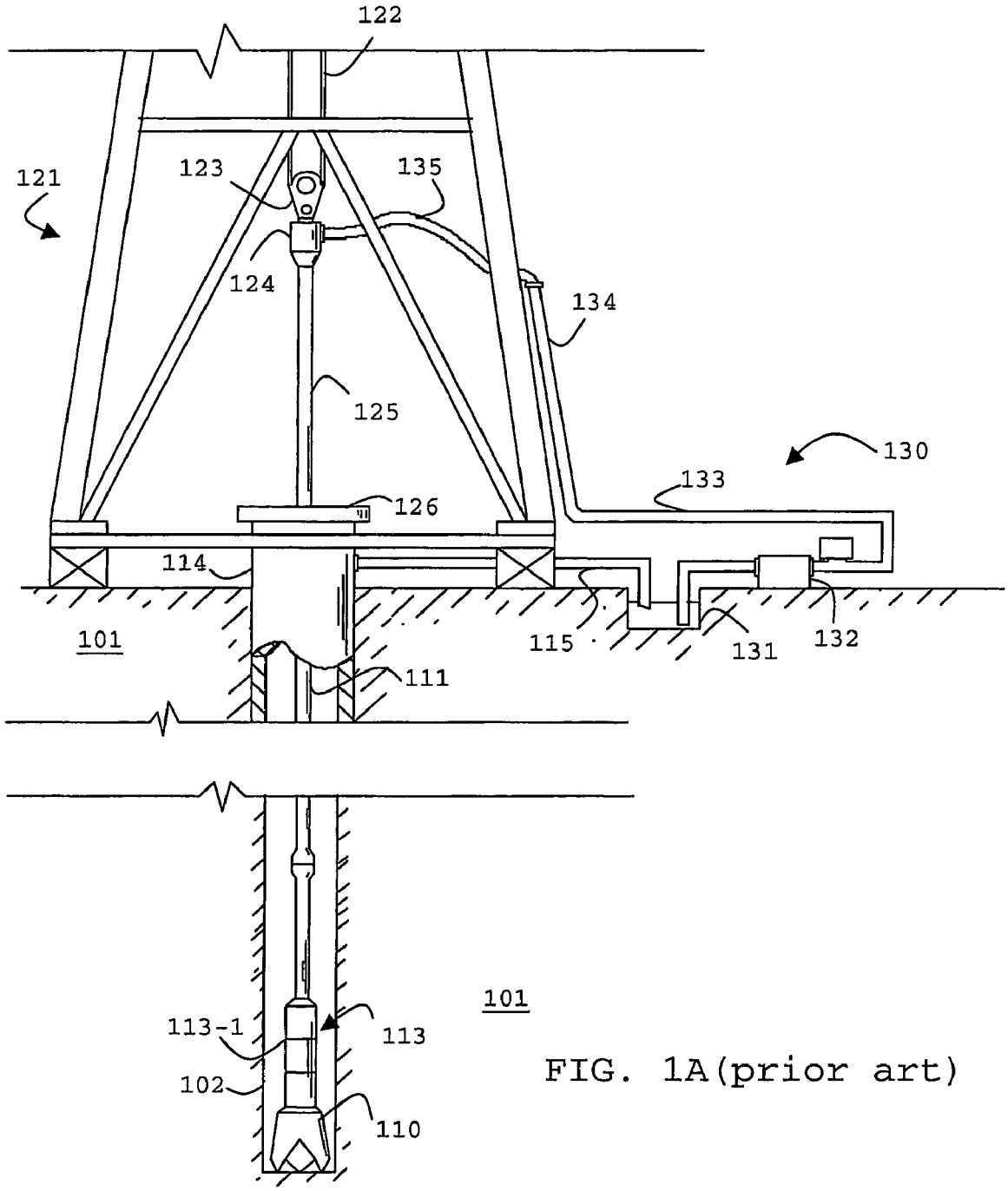
FIG. 1A(prior art)
FIG. 1A shows a known drilling system.

In FIG. 1, there is shown a known well drilling system for rotary drilling operations. A drill string 111 is shown within a borehole 102. The borehole 102 is located in the earth 101. The borehole 102 is being cut by the action of the drill bit 110. The drill bit 110 is disposed at the far end of a bottom hole assembly (BHA) 113 that is attached to and forms the lower portion of the drill string 111. The bottom hole assembly 113 contains a number of devices including several drill collars 113-1 to increase the weight on the bit 110.

The drilling surface system includes a derrick 121 and a hoisting system, a rotating system, and a mud circulation system 130. The hoisting system which suspends the drill string 111, includes the draw works 122, a hook 123 and a swivel 124. The rotating system includes a kelly 125, a rotary table 126, and engines (not shown). The rotating system imparts a rotational force on the drill string 111 during a rotational drilling operation in a manner well known in the art.

A mud circulation system 130 pumps drilling fluid down the central opening in the drill string 111. The drilling fluid is often called mud, and it is typically a mixture of water or diesel fuel, special clays, and other chemicals. The drilling mud is stored in a mud pit 131. The drilling mud is drawn into mud pumps 132 which pump the mud though the surface pipe system 133, the stand pipe 134, the kelly hose 135, and the swivel 124, which contains a rotating seal, into the kelly 125 and finally through the drill string 111 and the drill bit 110.

As the teeth of the drill bit grind and gouges the earth formation into cuttings the mud is ejected out of openings or nozzles in the bit 110 with great speed and pressure. These jets of mud lift the cuttings off the bottom of the hole and away from the bit, and up towards the surface in the annular space between drill string 111 and the wall of borehole 102. At the surface the mud and cuttings leave the well through a side outlet in a blowout preventer 114 and through the mud return line 115. The blowout preventer 114 comprises a pressure control device and a rotary seal. From a cuttings separator (not shown) the mud is returned to mud pit 131 for storage and re-use.

Although a system with jointed drill string 111, a kelly 125 and rotary table 126 is shown in FIG. 1, the invention is applicable to other drilling systems such as in top drive drilling derricks or coiled tubing. Although the drilling system is shown as being on land, it is applicable to marine and transitions zone environments.

Figure 1B:
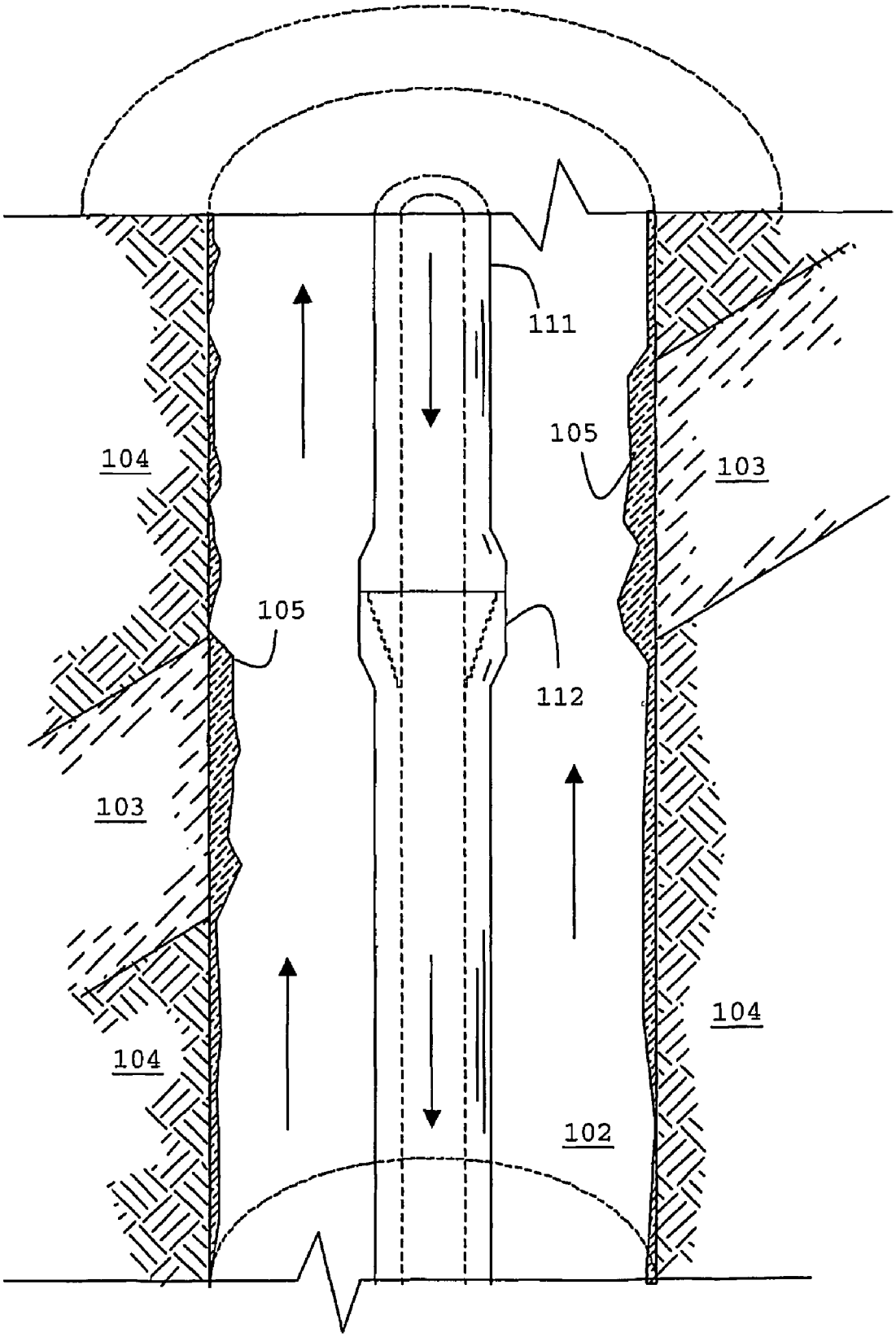
FIG. 1B(prior art)
FIG. 1B shows a detail of the well of FIG. 1A.

In FIG. 1B there is shown a part of an open hole section of the borehole 102. The section shown in FIG. 1B includes a section of the drill string 111 with a tool joint 112 in the center of the open, i.e. uncased, borehole 102. The borehole traverses a porous formation layer 103 embedded within layers of impermeable rock 104. The drilling fluid is circulated through the drill pipe 111 and returns loaded with cuttings through the annulus between the wall of the borehole 102 and the pipe 111 as indicated by arrows.

During the drilling operations, a small amount of the liquid components of the drilling fluid are absorbed by the formation leaving behind a layer of solid particles 105. As indicated in FIG. 1B, the mud cake layer 105 is thicker across the porous formation layers 103 than across impermeable layers 104. The mud cake layer 105 is believed to enhance the stability of the well.

With regard to the present invention it was found that most tools employed during conventional rotary drilling are not designed to make a continuous contact with the borehole wall and, thus, with the mud cake layer 105. Depending on the trajectory of the well, the drill string 111 makes occasional and localized contact, for example in bends and along horizontal sections of the well. Other known tools, such as stabilizers (not shown), though exceeding the diameter of the pipe joints 112, may contact the borehole wall more often, however these contacts again are localized in the sense that they do not affect the full circumference of a freshly drilled borehole. Moreover, due to the design of conventional stabilizer blades, these contacts are likely to rake into and damage the mud cake layer 105.

In order to preserve and possibly enhance the stability of the mud cake layer 105, the invention proposes the use of tools that exert force or pressure in a continuous or quasi-continuous manner on the wall of the borehole as the drilling operation progresses. Rather than cutting through the mud cake, the novel tools are designed to slide on the filter cake gently compressing or compacting it, thus forcing more fluid or particles into the surrounding formation and/or solidifying the mud cake layer 105 not unlike wall plastering. The compacting force is exerted in a radial direction, perpendicular to the wall of the borehole. The force exerted by the tool in other (lateral) directions, particularly in direction parallel to the axis of the well and drill string is minimized so as to minimize drag resistance as the tool glides further into or out of the well. This can be achieved by rounding the edges of the subpart in the direction of these movements. Furthermore such edges are beneficial as reducing cutting impacts on the wall.

Figure 2A:
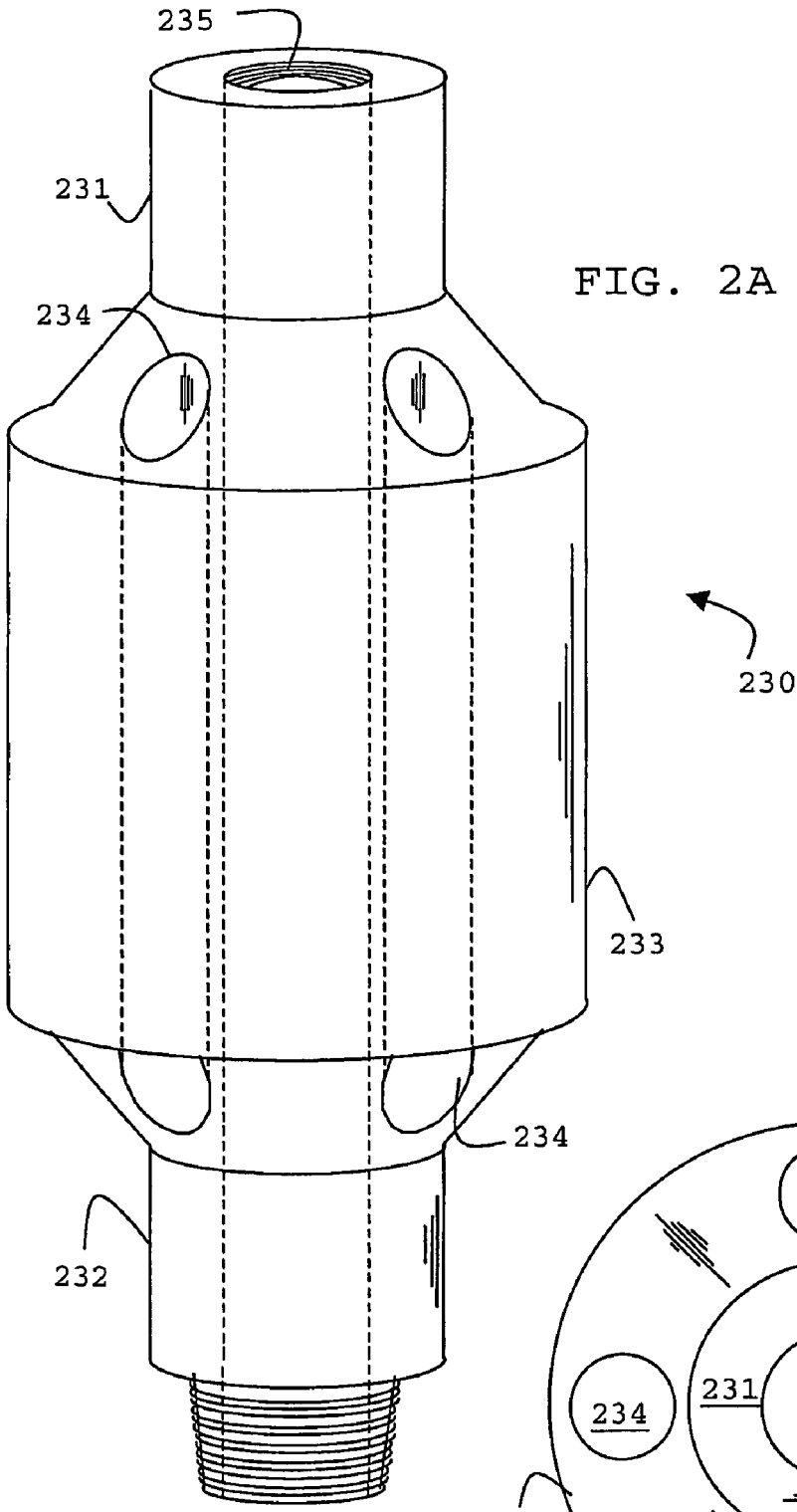
FIG. 2A is a perspective side view of a subpart of the drill string in accordance with an example of the invention.
Figure 2B:
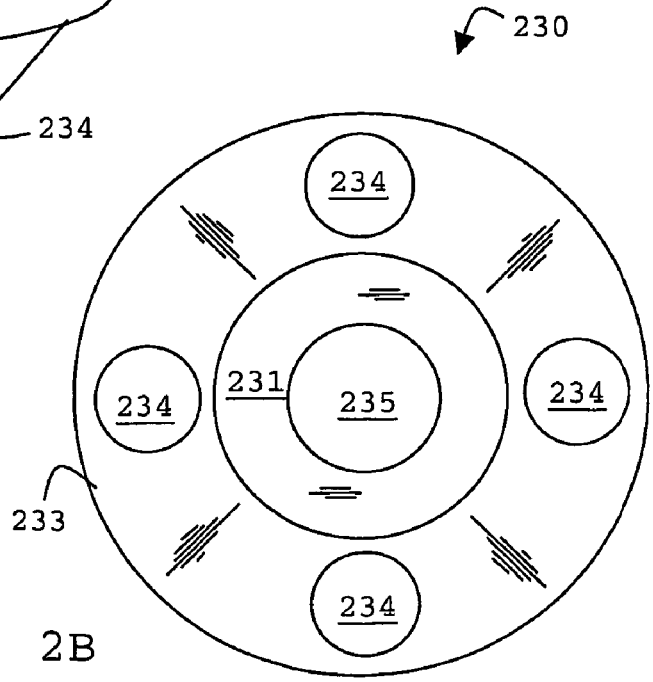
FIG. 2B is a top view of a subpart of FIG. 2A.

According to a first example of an embodiment of the invention, a metal drill collar with a large outer diameter (OD) is inserted into the BHA. A suitable design for such an enlarged OD drill collar is shown in FIG. 2.

The subpart 230 has standard drill collar pin and box connector sections 231, 232 at its upper and lower end, respectively. These sections have an OD equal to that of the other drill collars in the BHA. In the middle section of the subpart the OD gradually increases to the larger OD of a main section 233. The main section has a cylindrical shape. Four openings 234 are drilled through the main section 233 co-axially with the main axis of the sub. The openings have a diameter that is sufficiently large to prevent blockage by cuttings. The openings provide additional flow paths for the return flow of the mud. A large central bore 235 through the sub allows drilling fluid to flow from a surface location to the drill bit (not shown).

In this embodiment, the novel subpart has no movable elements and hence a constant OD. The diameter of the outer circumferential surface of the main section 233 does not dynamically adapt to the width of the borehole or any variation therein. Hence, it is seen as being important to choose an OD that nearly matches the nominal diameter of the borehole as drilled by the drill bit.

It is generally known that the actual diameter of a borehole may not exactly match the nominal drilling radius of the drill bit for a number of reasons linked to the formation properties and any changes introduced through the drilling process. While often the actual diameter of the well exceeds its nominal diameter, stress changes and swelling effects may cause shrinkage of the well bore diameter even in absence of any major collapse of the surrounding formation. Therefore, the OD of the subpart 230 is reduced when compared with the nominal OD of borehole. The exact size of this reduction may vary depending on the drilling conditions. As however the subpart is designed to be in contact with the wall of the well, the safety margin in the above example is set to 5 percent of the nominal diameter.

Figure 2C:
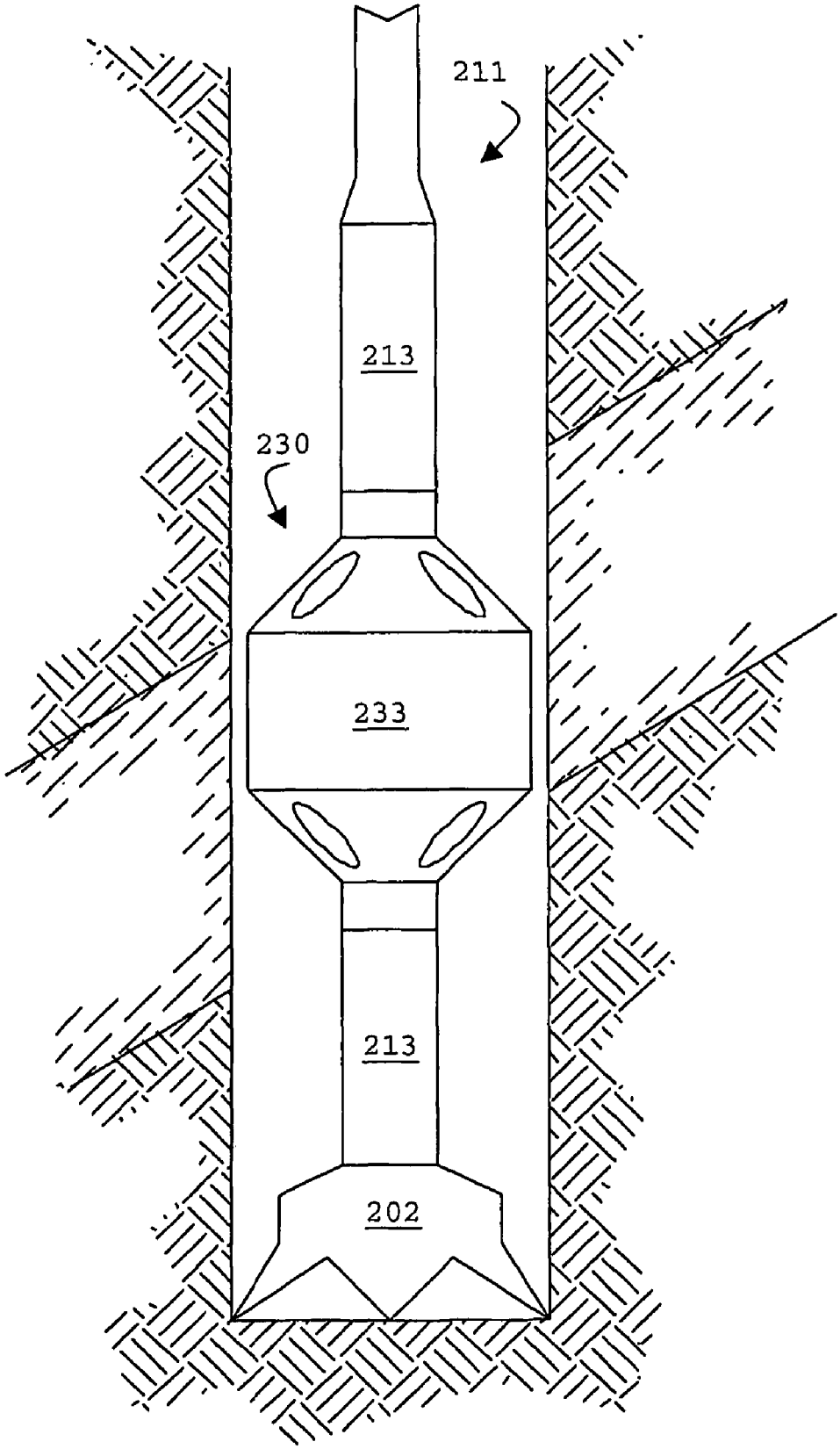
FIG. 2C shows the subpart of FIG. 2A,B in a well as part of a bottom hole assembly.

Even though slightly reduced with regard to the borehole diameter, the OD of the subpart 230 still exceeds those of other parts usually encountered in the assembled drill string. In FIG. 2C, there is shown a schematic drawing of the bottom part of a drill string 211 including a drill bit and a first and a second section of drill collars 213. Between these two sections is located a subpart 230 as shown in detail in FIGS. 2A and B. Above the drill collar section 213 the drill string continues to the surface as a string of jointed drill pipes having a much reduced OD.

Whilst the drill collars 213 contact the formation in an irregular and spurious manner, the larger OD of the new sub ensures almost constant contact with the formation. Being firmly coupled to the drill string 211 and thus rotated with it, the cylindrical main section 233 contacts the formation and any mud cake layer in a rolling motion describing a circular, or more precisely, a helical path on the wall of the borehole as the drill bit 202 penetrates through the formation.

In the above-described example, the angle of attack at which the circumference of the subpart contacts the formation is a function of the radius of the subpart and the radius of the borehole. Though in a strictly mathematical sense the two surfaces meet at an angle of attack that differs by an infinitesimally small amount from zero, the actual macroscopic angle of attack is small but finite, and may vary. It is estimated to range between 0.5 and 1 degrees.

The angle of attack is further described in FIG. 3, showing the formation wall 301 in interaction with the circumferential surface of known parts of a drill string, such as joints and stabilizers, and the outer circumferential surface 333 of the main body of the novel subpart of FIG. 2. The dashed line or plane 302 tangential to the wall 301 at the point or line of contact indicates an angle of attack of zero degrees.

Figure 3A:
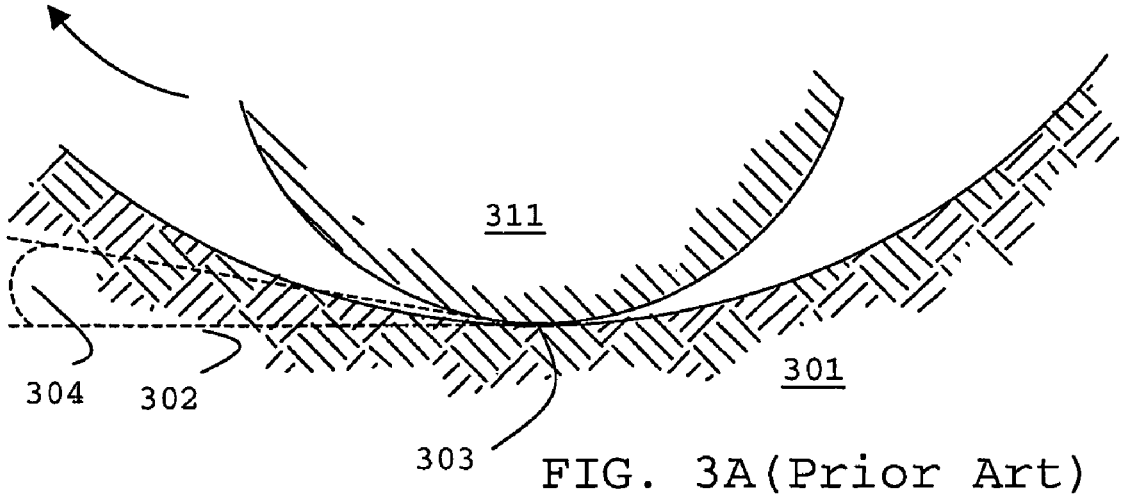
FIG. 3A(Prior Art)
FIG. 3A,B illustrate the angle of attack and the interaction of known parts of a drill string with the formation wall in a wellbore.
Figure 3B:
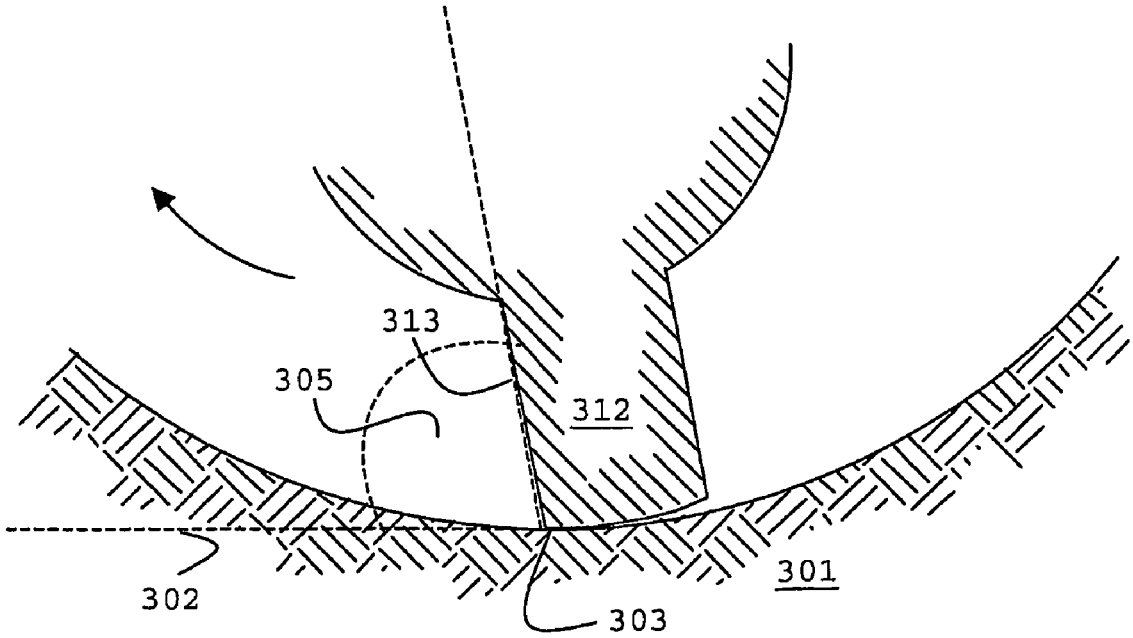
FIG. 3B(Prior Art)
FIG. 3C illustrates the angle of attack and the interaction of a tool in accordance with the present invention with the formation wall in a wellbore.

In FIG. 3A, there is shown a drill string joint 311 of a conventional drill string contacting the wall 301. The tangential plane 302 to the point of contact 303 is shown as a dashed line. Without considering deformations or indentation the angle of attack is zero. However the actual angle of attack 304 as shown may be slightly larger due to the manner in which the surface 311 and the wall 301 engage under downhole operation conditions. Nonetheless the actual angle of attack 304 is small compared to the angle of attack of a stabilizer sub as illustrated in the following FIG. 3B.

A part of a stabilizer 312 is shown engaging the wall 301 at the point of contact 303. The edge 313 of the stabilizer attacks the formation at an angle of attack 305 of approximately 80 degrees, using again the tangential plane 302 as reference.

Figure 3C:
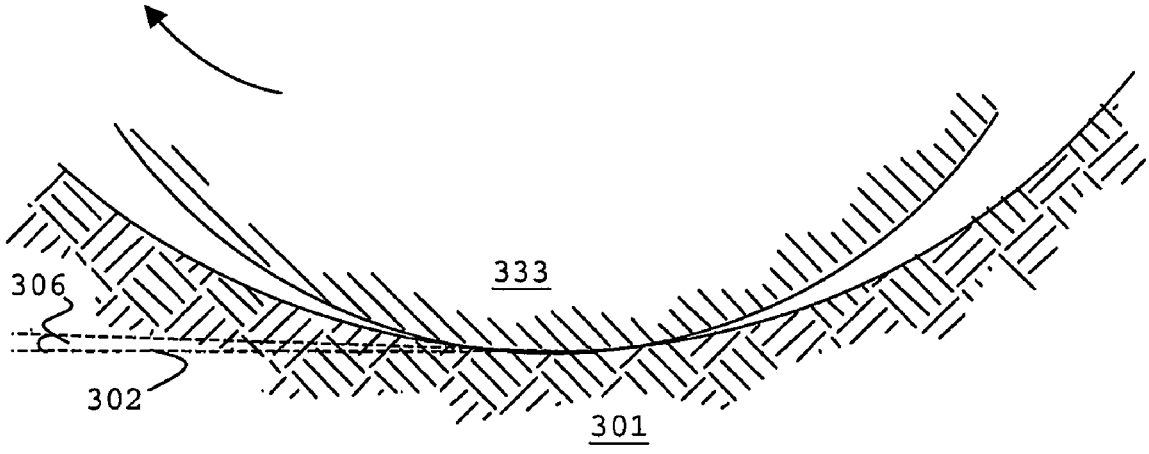

In FIG. 3C there is illustrated the angle of attack 306 of a subpart in accordance with the present invention as described for example in FIG. 2. The radius of curvature of the subpart 333 is close to the radius of curvature of the formation wall, and, hence, the actual angle of attack 306 is extremely small and can only be shown in an exaggerated manner. By making assumptions as to the thickness of the mud cake layer the angle of attack can be estimated to be below 1 degree or less than 0.5 degrees.

Figure 4:
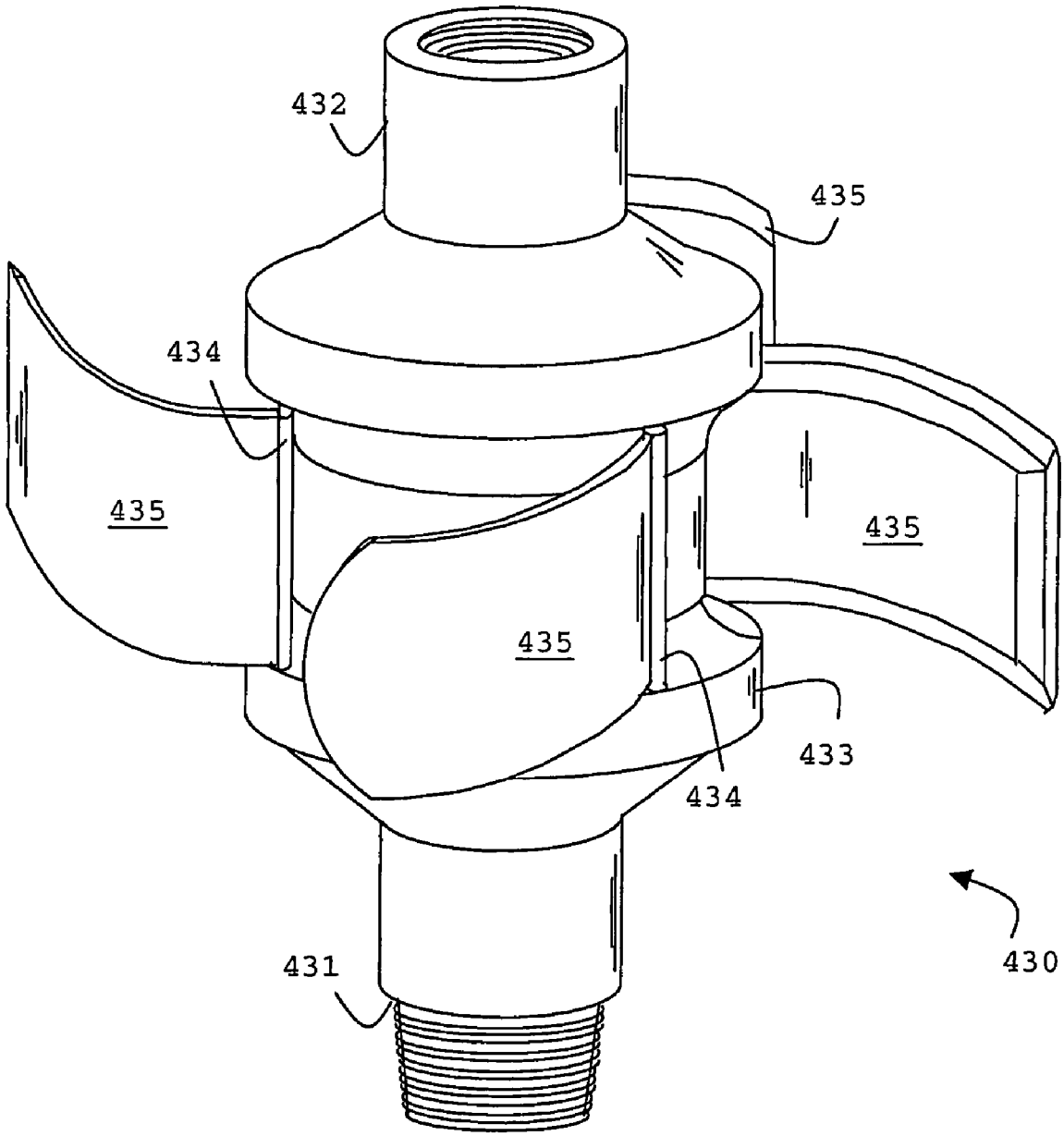
FIG. 4 shows a subpart of the drill string in accordance with another example of the invention.

A second example of a subpart in accordance with the present invention is shown in FIG. 4. The subpart 430 includes a bottom and upper section 431, 432, respectively, providing box and pin connection to the remainder of the drill string (not shown). A main body 433 of the subpart comprises two frustro-conical sections with a cylindrical middle section similar to a bobbin. The conical sections include the bearings for four hinges 434. Mounted onto each of the hinges is a steel vane or pad element 435 having a flat arcuate shape with rounded edges, to reduce forces against any lateral movement of the subpart.

The hinges 434 are spring-loaded to force the four pads to fold tightly around the main section in the absence of hydraulic pressure. The drilling fluid provides the hydraulic pressure as it is pumped from a surface location through the drill string. The pressurized drilling fluid activates internal cylinders (not shown) that rotate the vanes 435 around the hinges thus bringing their distal ends closer to the wall of the borehole. While the drill string remains in a centered position within the borehole, the rollers are designed to provide the first area of contact between the subpart 430 and the formation wall. The hinge-mounted vanes or pads 435 are configured to bend or flex as the radial distance between the drill string and the wall varies during the drilling operations, so as to remain in permanent contact with the wall.

During the drilling process, the drill string including the subpart 430 are rotated from the surface, and the subpart continuously exerts pressure on the formation wall and any mud cake layer on its surface. When the drilling terminates and the pressure inside the drill string drops, the vanes 435 fold back around the main body 433 to facilitate a subsequent tripping operation.

Figure 5:
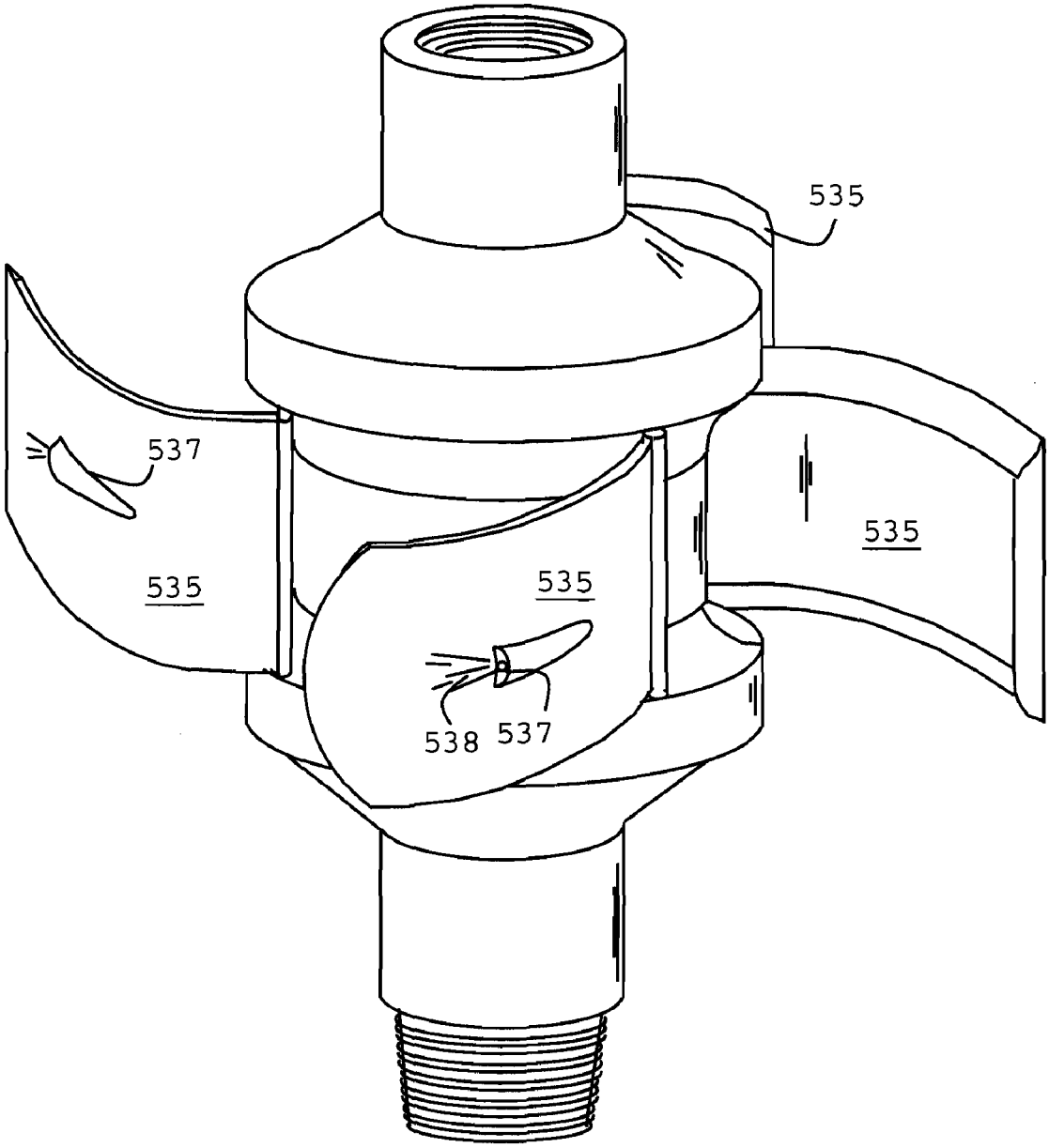
FIG. 5 shows a variant of the subpart of FIG. 4.

In a variant of this example illustrated in FIG. 5 flexible tubes are incorporated into the vanes 535. The tubes terminate in nozzles 537 located at the center of the pads. Other elements in FIG. 5 are equivalent to those of FIG. 4 and are hence not further described.

In operation these tubes are fed by pressurized drilling fluids through ports (not shown) from the inside of the drill pipe. The jets 538 of drilling fluids from the nozzles can be used to spray the formation. Or they can be directed against sections of the subpart to lubricate or remove deposits on those sections.

Figure 6:
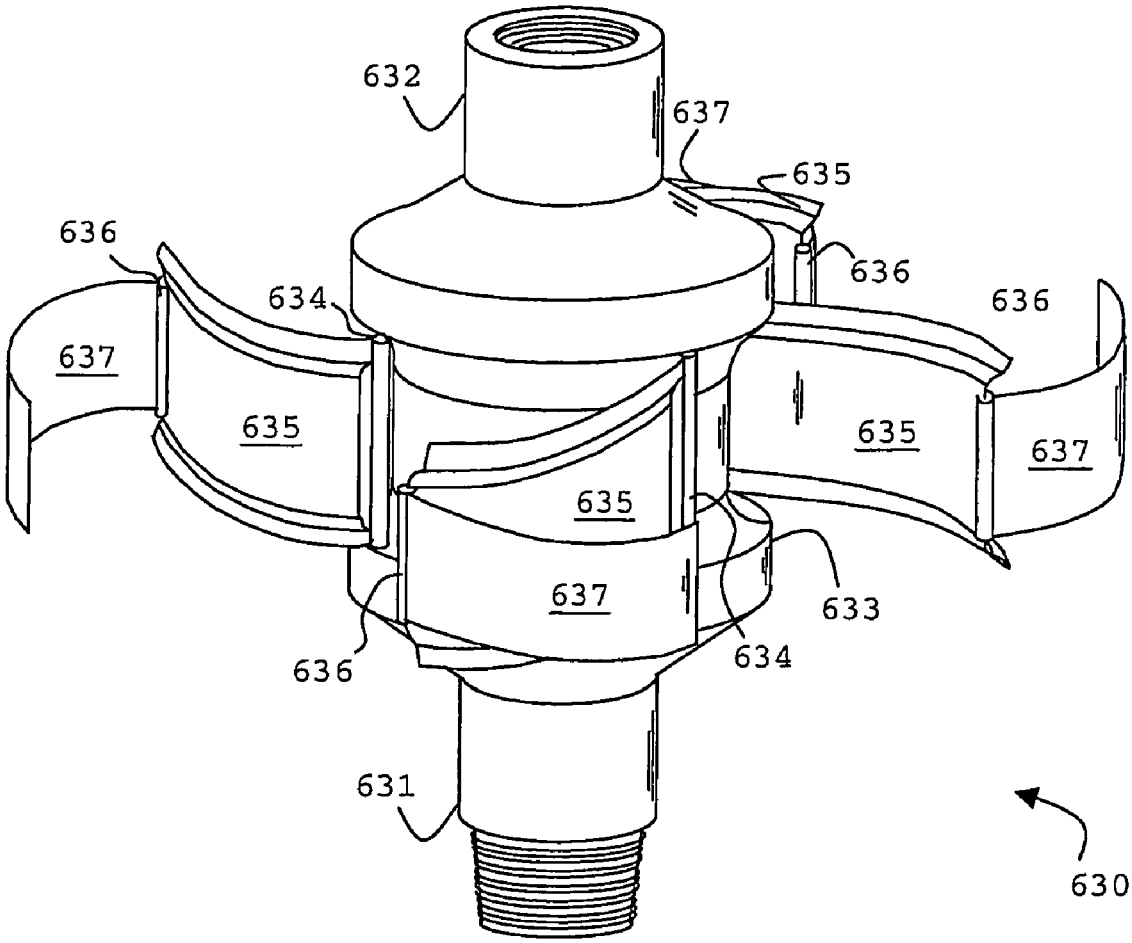
FIG. 6 shows a subpart of the drill string in accordance with another example of the invention.

A further variant of the example of FIG. 4 is shown in FIG. 6. As in the previously described example the subpart 630 includes a bottom and upper section 631, 632, respectively providing box and pin connection to the remainder of the drill, string. The main body 633 of the subpart comprises two frustro-conical sections with a cylindrical middle section similar to a bobbin. The conical sections include the bearings for four hinge elements 634. Mounted onto each of the hinges is a first inner arm section 635 having an arcuate shape with a depressed central area along its length. At the distal end of the first arm section there is mounted a second outer arm section 637 on a second hinge 636. The second outer arm section is arcuate, thus contacting the wall of the formation with a high rake angle. The edges of the outer arms 637 are rounded to prevent the arms from damaging the mud cake during when moving deeper into the well bore during drilling.

The hinge elements 634, 636 are spring-loaded to force both arm sections 635, 637 to fold tightly around the main section 633 in the absence of hydraulic pressure. The drilling fluid provides the hydraulic pressure as it is pumped from a surface location through the drill string. The pressurized drilling fluid activates cylinders (not shown) that unfold the arm sections until the outer arm meets resistance by the borehole wall. The arcuate blade-like arms 635, 637 are made of metal and exhibit sufficient inherent flexibility to ensure that the arms 635, 637 engage the wall without causing damage to mud cake, formation or to the arms themselves. The curvature of the blades again is chosen such that the angle of attack with which it engages the wall of the borehole is below 1 degree.

A novel subpart with compliant elements such as illustrated by FIGS. 4-6 can be assembled into a drill string at any desired location. The subpart could be made part of the BHA or could be assembled into the drill string at a location above the BHA and the drill collars. It is possible to include several of these subparts in a drill string and thus repeat the compacting operation the subpart perform on the mud cake several times over, thus reinforcing the action of a previous subpart.

While the invention has been described in conjunction with the exemplary embodiments described above, many equivalent modifications and variations will be apparent to those skilled in the art when given this disclosure. For example, one may replace the arcuate arms of the example above by cylindrical or cone rollers. Accordingly, the exemplary embodiments of the invention set forth above are considered to be illustrative and not limiting. Various changes to the described embodiments may be made without departing from the spirit and scope of the invention.

The invention claimed is:

1. A subpart of a drill string, the subpart comprising a central main section and two or more extendable elements adapted to extend under drilling conditions to contact an inner wall of the borehole and to exert a compacting pressure on at least one of mud cake or cuttings present in an annulus between the drill string and said wall, wherein the two or more extendable elements include one or more nozzles connected by a flow path to one or more inner openings in the subpart, and wherein the one or more inner openings are configured to allow drilling fluid to flow through the subpart.

2. The subpart of claim 1 further comprising a bottom and top section for connection to the drill string.

3. The subpart of claim 2 wherein the main section comprises one or more bores providing a return flow path for the drilling fluid and cuttings.

4. The subpart of claim 2 wherein at least one of the bottom and top sections comprises a connector adapted to connect to a drill collar section of the drill string.

5. The subpart of claim 2 wherein the bottom and top section are configured to provide a force-transmitting connection to the drill string so that the subpart follows a rotational motion of the drill string generated at a surface location.

6. The subpart of claim 1 wherein the two or more extendable elements are made from an abrasive resistant material.

7. The subpart of claim 1 wherein the two or more extendable elements engage under drilling conditions the wall of the borehole at an angle of attack of less than 45 degrees.

8. The subpart of claim 1 wherein the two or more extendable elements are adapted to engage the wall of the borehole when pressurized drilling fluid is pumped from a surface location through the drilling string.

9. The subpart of claim 1 wherein the two or more extendable elements include one or more hinge sections.

10. The subpart of claim 1 wherein each of the two or more extendable elements comprises a first extendable section and a second extendable section and a hinge element connecting said first and second extendable sections.

11. The subpart of claim 1 wherein each of the two or more extendable elements comprises an arcuate vane element rotatably mounted on a hinge element.

12. A method of consolidating a borehole during a drilling operation comprising the steps of assembling a drill string including one or more subparts each having an outer circumferential surface which is contoured and adapted to engage a wall of an open uncased borehole with a low angle of attack essentially continuously exerting a compacting pressure on at least one of mud cake or cuttings present in the annulus between the drill string and said wall;

pumping from a surface location a drilling fluid;

using the drilling fluid to force the outer circumferential surface into contact with the formation;

rotating said drill string from said surface location; thereby causing the subpart or subparts to slide along the wall of the borehole.

13. The method of claim 12 wherein the outer circumferential surface of the one or more subparts is essentially continuously forced into contact with the wall surrounding the borehole during the drilling operation.

14. The method of claim 12 wherein the outer circumferential surface comprises an outer surface of one or more elements hingedly attached to the one or more subparts.

15. A subpart of a drill string, the subpart comprising a central main section and two or more extendable elements adapted to extend under drilling conditions to contact an inner wall of the borehole and to exert a compacting pressure on at least one of mud cake or cuttings present in an annulus between the drill string and said wall, wherein each of the two or more extendable elements comprises a first extendable section and a second extendable section and a hinge element connecting said first and second extendable sections.

16. A subpart of a drill string, the subpart comprising a central main section and two or more extendable elements adapted to extend under drilling conditions to contact an inner wall of the borehole and to exert a compacting pressure on at least one of mud cake or cuttings present in an annulus between the drill string and said wall, wherein each of the two or more extendable elements comprises an arcuate vane element rotatably mounted on a hinge element.

* * * * *